US011643757B2

(12) United States Patent
Werheit et al.

(10) Patent No.: US 11,643,757 B2
(45) Date of Patent: May 9, 2023

(54) OPTIMIZATION OF THE OPERATION OF A SPINNING MACHINE

(71) Applicant: Saurer Spinning Solutions GmbH & Co. KG, Übach-Palenberg (DE)

(72) Inventors: Patrick Werheit, Aachen (DE); Jörg von Livonius, Hückelhoven (DE); Philipp Schiffers, Erkelenz-Gerderath (DE); Anna Turowski, Mönchengladbach (DE); Jürgen Hüls, Meerbusch (DE); Jan Märtin, Schwalmtal (DE); Michael Spitzer, Monschau-Kalterherberg (DE)

(73) Assignee: Saurer Spinning Solutions GmbH & Co. KG, Übach-Palenberg (DE)

( * ) Notice: Subject to any disclaimer, the term of this patent is extended or adjusted under 35 U.S.C. 154(b) by 0 days.

(21) Appl. No.: 16/904,541

(22) Filed: Jun. 17, 2020

(65) Prior Publication Data

US 2020/0399792 A1 Dec. 24, 2020

(30) Foreign Application Priority Data

Jun. 18, 2019 (DE) ..... 102019116475.3

(51) Int. Cl.
*D01H 4/44* (2006.01)

(52) U.S. Cl.
CPC ..... *D01H 4/44* (2013.01)

(58) Field of Classification Search
CPC ..... D01H 1/20; D01H 4/42; D01H 4/44; D01H 13/32
See application file for complete search history.

(56) References Cited

U.S. PATENT DOCUMENTS 5,551,223 A * 9/1996 Nickolay ..... D01H 13/32 57/1 R
5,801,949 A * 9/1998 Raasch ..... B65H 54/26 700/130

(Continued)

FOREIGN PATENT DOCUMENTS

DE 2508113 A1 10/1975
DE 102004053505 A1 5/2006

(Continued)

OTHER PUBLICATIONS

Extended European Search Report, European Application No. 20179126.6, dated Dec. 3, 2020, all enclosed pages cited.

(Continued)

*Primary Examiner* — Shaun R Hurley
*Assistant Examiner* — Patrick J. Lynch
(74) *Attorney, Agent, or Firm* — Nelson Mullins Riley & Scarborough LLP

(57) ABSTRACT

A method for optimizing the operation of a spinning machine with regard to quality and productivity is provided. An apparatus, comprising a control device and the spinning machine is provided. A yarn having specified yarn properties is produced, a quality parameter of the yarn is sensed during the spinning operation, a parameter for setting the production speed is specified, the quality parameter and the parameter for setting the production speed are evaluated, and the production speed is set in dependence on a target variable, the target variable comprising the quality parameter.

12 Claims, 3 Drawing Sheets

(56) References Cited

U.S. PATENT DOCUMENTS

| | | | | |
|---|---|---|---|---|
| 2002/0103565 | A1* | 8/2002 | Hosel | D01H 13/32 700/130 |
| 2004/0024484 | A1* | 2/2004 | Bahlmann | D01H 13/26 700/130 |
| 2007/0137165 | A1* | 6/2007 | Biermann | D01H 13/32 57/264 |
| 2014/0360151 | A1* | 12/2014 | Meyer | D01H 4/50 57/308 |
| 2019/0211480 | A1* | 7/2019 | Bahlmann | G06F 3/04886 |

FOREIGN PATENT DOCUMENTS

| | | | | |
|---|---|---|---|---|
| DE | 102016118708 | A1 * | 4/2018 | D01H 13/32 |
| EP | 0365931 | A1 | 5/1990 | |
| EP | 0877108 | B1 | 7/2003 | |
| EP | 2565306 | A2 * | 3/2013 | D01H 4/44 |
| GB | 2196351 | A | 4/1988 | |
| WO | 93/05477 | A1 | 3/1993 | |
| WO | WO-2018101240 | A1 * | 6/2018 | B65H 54/74 |

OTHER PUBLICATIONS

First Examination Report Issued in European Application No. 20179126.6, dated Oct. 28, 2022, all enclosed pages cited.

* cited by examiner

OPTIMIZATION OF THE OPERATION OF A SPINNING MACHINE

CROSS-REFERENCE TO RELATED APPLICATION

This application claims priority from German National Patent Application No. DE 10 2019 116 475.3, filed Jun. 18, 2019, entitled "Optimierung des Betriebes einer Spinnmaschine", the entire contents of which are incorporated herein by reference.

FIELD OF THE INVENTION

The present invention relates to a method for optimizing the operation of a spinning machine, more particularly an open-end rotor spinning machine or an air-nozzle spinning machine, with regard to quality and productivity. The invention also relates to an apparatus, comprising a control device and the spinning machine.

BACKGROUND OF THE INVENTION

European Patent Publication EP 2 565 306 B1 discloses an open-end rotor spinning machine, in the case of which the rotational speed of the spinning rotors is set automatically in dependence on a determined yarn break rate and the yarn break rate is thereby controlled in such a way that the yarn break rate lies in a specified target range below a maximum yarn break rate. The rotational speed of the spinning rotor directly determines the production speed of the open-end rotor spinning machine. The yarn take-off speed and the feed-in speed of the sliver are changed in accordance with the rotational speed of the spinning rotor so that specified yarn parameters or yarn properties are maintained when the rotational speed of the spinning rotors changes.

In rotor spinning, yarn is formed in the rotor groove of the spinning rotor. Here, the deposited fibres are twisted by the torsional moment of the circulating yarn end. This twist products the yarn strength necessary for the yarn take-off. As the yarn is taken from the rotor groove, the yarn must have a strength greater than the centrifugal force in the rotor, which centrifugal force is produced by the yarn circulation. Otherwise, the yarn would tear already in the area of the rotor. While the tearing force is nearly constant, the centrifugal force of the circulating yarn end increases quadratically with increasing rotor rotational speed. Thus, a doubling of the rotor rotational speed leads to four times the yarn tension in the area of the rotor. The risk of a yarn break in the area of the rotor therefore increases as the rotor rotational speed increases.

The yarn break rate that can be accepted during the operation of an open-end rotor spinning machine depends on the number of available means for remedying yarn breaks. The yarn break rate is the number of yarn breaks in relation to the operating time of the open-end rotor spinning machine or a workstation. The yarn break is remedied by piecing. The piecing can occur semi-automatically, meaning that an operator is required for the piecing. The piecing can also be effected automatically by means of a piecer carriage. Machines in which the piecing can be automatically performed in an autonomous manner at a workstation are also known. In the first case, the number of acceptable yarn breaks depends on the number of available operators. In the second case, the permissible yarn break rate is determined by the number of piecer carriages. In the case of autonomous piecing at the workstations, the number of piecings that can be performed in parallel without interfering with a sufficient supply of vacuum is important. A maximum permissible number of yarn breaks can be defined on the basis of the described conditions.

The speed at which the yarn is produced and thus the productivity of the open-end rotor spinning machine increase as the rotor rotational speed increases. Therefore, it is desirable that the spinning rotors are operated at the maximum possible rotational speed.

German Patent Publication DE 10 2004 053 505 A1 discloses a method for optimizing the productivity of an air-nozzle spinning machine by reducing the production speed when there is an increased number of yarn breaks and increasing the production speed when there is a reduced number of yarn breaks. Here as well, the production speed is thus set in dependence on the yarn break rate. To change the production speed, the delivery speed and the take-off speed are set accordingly. In order that the spinning twist remains constant in relation to the delivery speed, the compressed air is set accordingly in dependence on the production speed.

The previously mentioned documents consider only the productivity of the spinning machines. However, the quality of the produced yarn is also crucial. Therefore, what are referred to as yarn clearers are known in the prior art, as described, for example, in European Patent Publication EP 0 877 108 B1.

Yarn clearers sense measurable properties of the yarn during the production of the yarn. In this way, yarn defects should be determined. A clearing limit can be used to define which yarn defects are cleared and which stay in the yarn. In addition to the clearing of yarn defects, the yarn clearer also allows the quality of the yarn to be evaluated.

SUMMARY OF THE INVENTION

The problem addressed by the present invention is that of optimizing both the productivity and the quality during yarn production.

The problem is solved by means of a method for optimizing the operation of a spinning machine with regard to quality and productivity. As per the method according to the invention, a yarn having specified yarn properties is produced, a quality parameter of the yarn is sensed during the spinning operation, a parameter for setting the production speed is specified, the quality parameter and the parameter for setting the production speed are evaluated, and the production speed is set in dependence on a target variable, the target variable comprising the quality parameter.

The optimization is carried out preferably for an open-end rotor spinning machine or for an air-nozzle spinning machine.

The yarn properties are, for example, yarn count and yarn twist. The raw material that is used also influences the yarn properties. The yarn properties can preferably also be specified by means of machine parameters and/or production parameters. This includes in particular the spinning components, such as spinning rotors, opening rollers, navels and spinning nozzles. The spinning vacuum or spinning pressure, the drafting imparted by the spinning device, and the imparted twist also play a role. In the case of an open-end rotor spinning machine, the ratio between take-off speed, sliver feed and rotor rotational speed is important. In the case of an air-nozzle spinning machine, the ratio between spinning pressure and delivery speed is important.

Quality parameters preferably describe deviations from specified yarn properties. In order to optimize the production of the yarn, the CV value and/or IPI values are particularly preferably used. The CV value is a measure of the uniformity of the yarn; the less uniform the yarn is, the higher the CV value is. The IPI values are what are known as frequent yarn defects (imperfections), which, considered individually, are not deemed problematic. They mainly lie below the clearing range activated in the short defect matrix. IPI values can be specified for thick places, thin places and neps.

As already described above, especially the rotor rotational speed is considered as the parameter for setting the production speed in the case of an open-end rotor spinning machine. In order to maintain the yarn properties, the feed and the take-off speed must then be adapted accordingly. In the case of an air-nozzle spinning machine, the delivery speed can be selected as the parameter for setting the production speed. The spinning pressure is adapted in accordance with the delivery speed in order to maintain the yarn properties.

The invention is based on the insight that the production speed of the spinning machine has a direct influence on the quality of the produced yarn. The quality of the produced yarn decreases with increasing production speed. By setting the production speed in dependence on a quality parameter, the maximum productivity can be achieved while maintaining a desired quality. In order to increase the productivity further, the limits for the quality parameter can be adjusted.

The optimization can be carried out for the entire spinning machine, meaning that all workstations are operated at the same production speed. The setting process is then carried out preferably on the basis of average values or by evaluating the production speed and the quality parameter at a pilot spinning position. It is also possible to optimize each workstation individually. For this purpose, autonomous workstations equipped with individual drives are required. Each workstation can produce at its own individual production speed. Therefore, different limits for the quality parameter and different yarn properties can also be specified for each workstation. Groups of workstations at which yarns having the same yarn properties are produced can also be combined for the optimization.

The production speed is preferably set by means of a control device in dependence on a target variable, the target variable comprising the quality parameter. The control device can preferably be equipped with artificial intelligence.

Accordingly, the problem is also solved by means of an apparatus, comprising a control device and a spinning machine. The apparatus comprises means for producing a yarn having specified yarn properties, means for sensing a quality parameter of the yarn during the spinning operation, and means for specifying a parameter for setting the production speed. According to the invention, the control device is designed to evaluate the quality parameter and the parameter for setting the production speed, and the control device is designed in such a way that the production speed can be set by means of the control device in dependence on a target variable, the target variable comprising the quality parameter.

The control device can be part of the spinning machine, and in this case is preferably designed as a central control device and/or workstation controller. In addition to the tasks of the optimization according to the invention, the integrated control device preferably also takes on the known control functions of a spinning machine. However, the control device can also be (spatially) independent of the spinning machine. It is merely necessary that the required data can be exchanged between the control device and the spinning machine. For this purpose, the control device can be connected to the spinning machine via a network, e.g. within a spinning mill. The control device can then also be connected to additional spinning machines of the spinning mill for optimization. In certain embodiments described below, it can be advantageous for the control device and the spinning machine to be connected to the Internet. The control device can preferably be designed as or comprise a PC, laptop or tablet.

The means for producing a yarn are preferably designed as a spinning device, more particularly an open-end rotor spinning device or air-nozzle spinning device. The means for sensing a quality parameter of the yarn are preferably designed as yarn clearers. In order to specify a parameter for setting the production speed, an operating device can be provided.

As per an advantageous further development of the method according to the invention, the yarn break rate is sensed and evaluated and the target variable comprises the yarn break rate. Thus, in this embodiment the target variable comprises both the quality parameter and the yarn break rate. That is, the production speed is set both in dependence on the quality parameter and in dependence on the yarn break rate. The production speed is preferably set in such a way that both the quality parameter and the yarn break rate lie within specified limits. Thus, both productivity and quality can be optimally set. In this way, it can be ensured that the production speed is only so high that the yarn breaks that occur can still be remedied. The production speed is also limited in such a way that the quality parameter stays within the specified limits.

Accordingly, an advantageous embodiment of the apparatus according to the invention comprises means for sensing the yarn break rate, the control device is designed to evaluate the yarn break rate, and the target variable comprises the yarn break rate. Yarn breaks can be determined in a manner known per se by means of yarn monitors or by means of yarn clearers. A corresponding evaluating device evaluates the yarn breaks and determines the yarn break rate. The evaluating device can also be part of the control device.

As per a preferred embodiment, the control device comprises a user interface, on which the parameter for setting the production speed and the target variable are simultaneously displayed. That is, besides the parameter for setting the production speed, at least the quality parameter is displayed on the user interface. Depending on the configuration of the target variable, additional quality parameters and/or the yarn break rate are displayed on the user interface. The parameter for setting the production speed preferably also can be changed using the same user interface. The operator thus receives all the relevant information needed to set the production speed. The setting process is therefore simplified for the operator by means of the user interface. The user interface can be part of an operating device of the spinning machine or can be the screen of a PC, laptop or tablet.

Particularly clear is a display of the time curve of the parameter for setting the production speed and of the target variable on the user interface. This allows the operator to easily see how changes to the production speed affect the target variable and to decide whether the production speed can be increased or should be decreased.

A limit value for the target variable preferably can be specified to the control device. An upper limit value and a lower limit value for the quality parameter preferably are specified, or can be specified by means of the control device. In the case of the yarn break rate, the upper limit value is particularly important. The limit value or limit values are preferably also displayed on the user interface. A display of the limit value or limit values in the display of the time curve is also advantageous.

As per a possible embodiment of the apparatus according to the invention, the control device is designed to automatically change the production speed or the parameter for setting the production speed in dependence on the deviation of the target variable from the specified limit value.

The control device can preferably be designed to determine proposals for a change to the parameter for setting the production speed. The proposals are determined in dependence on the deviation of the target variable from the specified limit value. The proposal in question is preferably displayed to the operator on the user interface. The operator can then, in conjunction with a corresponding design of the control device, confirm the proposal or manually change the proposal and subsequently confirm the proposal. The change to the production speed is not made by the control device until confirmation is provided.

Principles of artificial intelligence can be used to optimally set the production speed of the spinning machine. In conjunction with the present invention, the method of case-based reasoning is particularly advantageous. In case-based reasoning, problems are solved using reasoning by analogy. In order to create the case base necessary for this purpose, the control device is designed to create and store data sets, which comprise the specified yarn properties, the parameter for setting the production speed, and the associated target variable. As already explained, the controller preferably has a connection to the Internet. Thus, not only local data sets but also data sets of other spinning mills are available. In this way, the case base can be significantly enlarged and the learning of the system can be accelerated.

In order to determine a suitable case from among the stored data sets, the control device is preferably designed to compare the data sets with the specified yarn properties and with a specified limit value for the target variable and to select a data set for the operation of the spinning machine in accordance with the comparison. The apparatus is preferably designed to apply the selected data set. That is, a data set is preferably selected by comparison and the spinning machine is preferably operated on the basis of the selected data.

The control device has an interface for editing the selected data set, so that the operator can evaluate and edit the selected data set.

The control device is preferably designed to apply and store the edited data set. Thus, the data set can be checked and subsequently the case base can be expanded.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The invention is explained in greater detail below on the basis of an embodiment example. The figures show.

DESCRIPTION OF THE PREFERRED EMBODIMENTS

The following description of the embodiments of the present invention is merely exemplary in nature and is in no way intended to limit the invention, its application, or uses. The following description is provided herein solely by way of example for purposes of providing an enabling disclosure of the invention, but does not limit the scope or substance of the invention.

Figure 1:
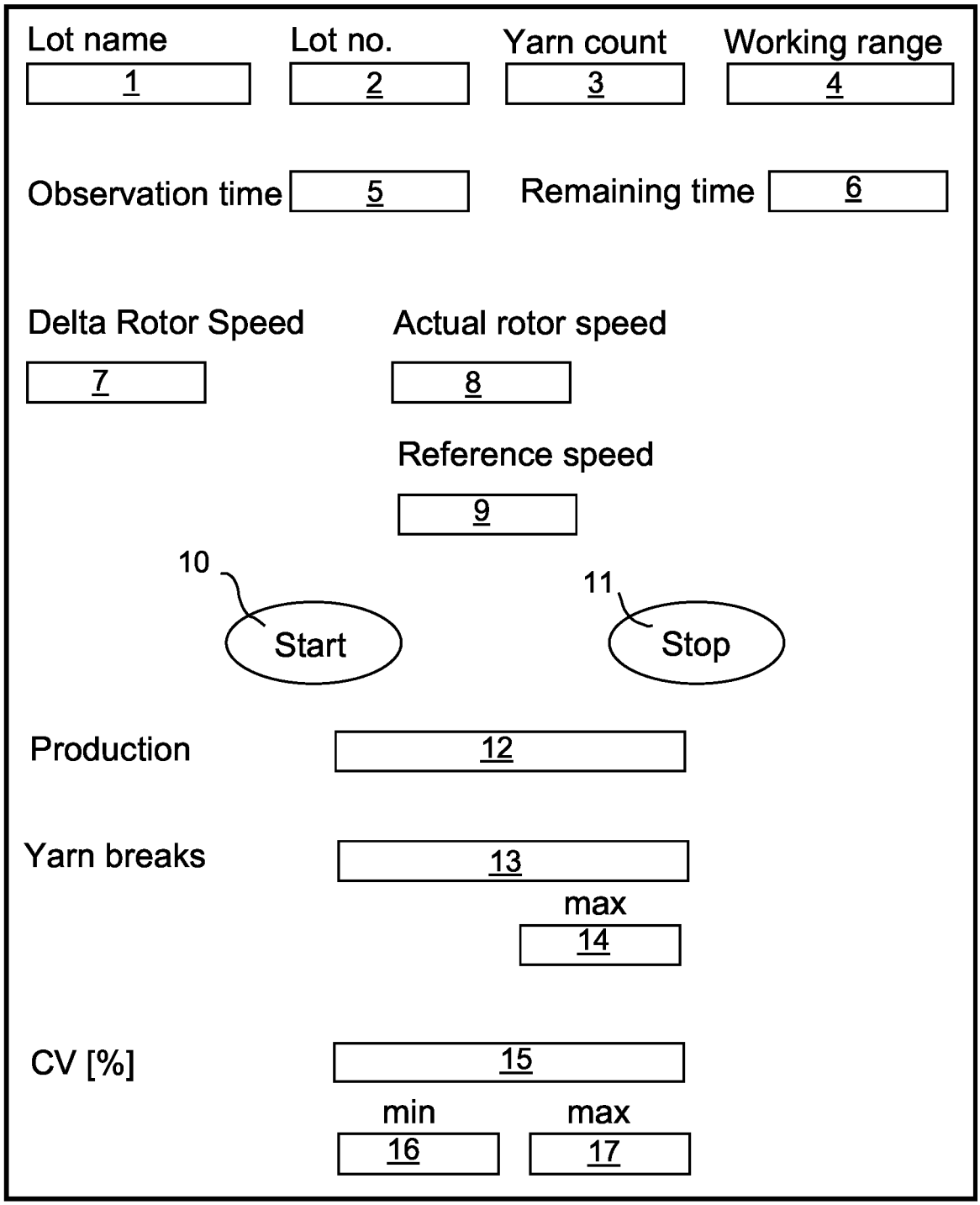
FIG. 1 illustrates a user interface for performing the optimization according to the invention.

FIG. 1 shows a user interface of a control device, by means of which the operator of the spinning machine can set the production speed in dependence on a target variable. In the embodiment example, the target variable comprises a quality parameter, namely a CV value, and the yarn break rate ("Yarn breaks"). The CV value is indicated in %. The embodiment example relates to an open-end rotor spinning machine.

The user interface initially contains indications that allow conclusions to be drawn about the yarn properties. The lot name is displayed in field 1, the lot number is displayed in field 2, the yarn number is displayed in field 3, and the work area is displayed in field 4. The work area indicates the spinning positions for which the optimization is performed. By indicating the lot number and the lot name, traceability of additional machine parameters and production parameters relevant to the yarn properties is ensured at all times.

The observation time that should be used for the optimization can be indicated in field 5. The remaining time is indicated in field 6. A reference rotational speed for the spinning rotor can be indicated in field 9. Furthermore, a step size ("Delta Rotor Speed") with which the rotor rotational speed is changed for optimization can be indicated in field 7. The upper limit ("max") for the yarn break rate is indicated in field 14. Field 16 allows a lower limit ("min") for the CV value to be input. The upper limit ("max") of the CV value is specified in field 17.

The optimization process is started by pressing the start button 10. The process can be interrupted or ended by pressing the stop button 11. The operation of the spinning machine starts initially with the reference rotational speed 9. The current rotor rotational speed is displayed in field 8. The ongoing production ("Production") is displayed in field 12. That is, the metres of produced yarn are indicated. Furthermore, the current yarn break rate 13 and the CV value 15 are indicated. Directly adjacent, the specified limit values are indicated. The operator thus sees at a glance whether and to what extent the yarn break rate 13 and the CV value 15 are at a distance from the limits. The operator can then change the rotor rotational speed directly by means of the reference rotational speed 9 or at the press of a key, by the previously defined step size 7.

In an alternative embodiment, the control device is designed to make proposals for a change to the rotor rotational speed. Such proposals can be displayed by means of a pop-up window, for example. An algorithm that calculates this proposal on the basis of the deviation of the yarn break rate 13 and the CV value 15 from the specified limit values 14, 16, 17 and on the basis of the step size 7 can be stored in the control device. Here, the operator again has the option of checking the proposal before the change to the rotor rotational speed is made.

Figure 2:
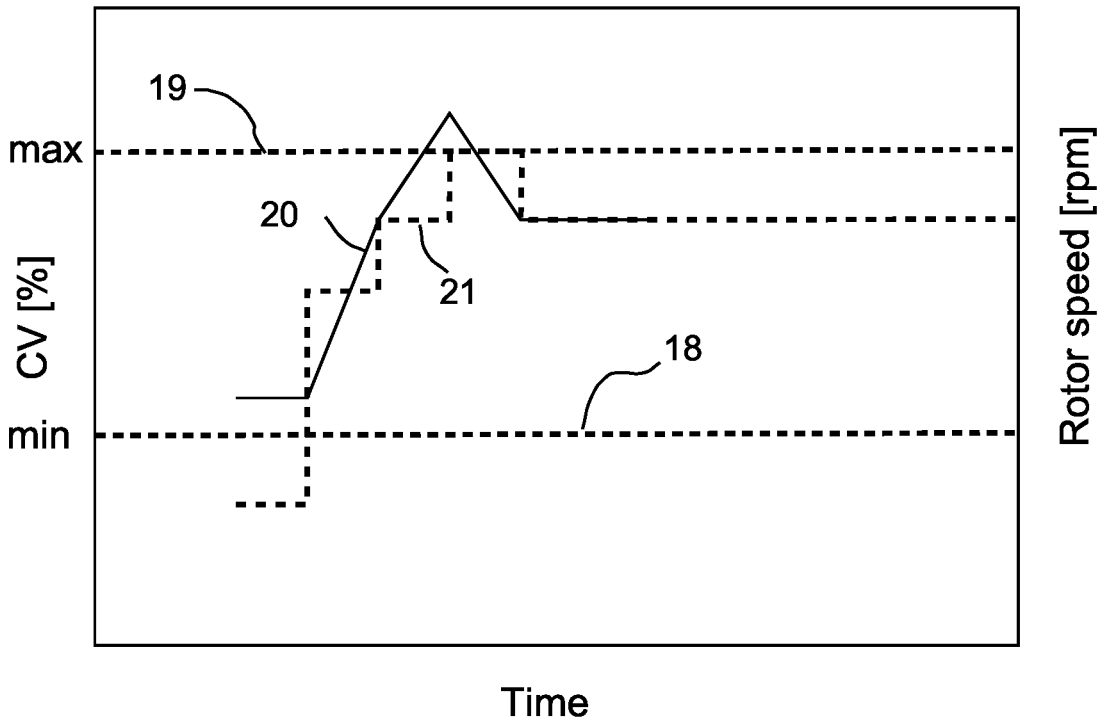
FIG. 2 illustrates a display of the time curve of the parameter for setting the production speed and of the target variable.

In order to facilitate the operator's decision about a change to the production speed, the time curve of the parameter for setting the production speed and of the target variable can advantageously be graphically displayed. FIG. 2 shows such a graphical display, again using the example of an open-end rotor spinning machine. A CV value is displayed as the target variable.

FIG. 2 shows, accordingly, the curve 20 of the CV value and the curve 21 of the rotor rotational speed over time ("Time"). The lower limit 18 and the upper limit 19 for the CV value are also displayed. At the start of the observation, the CV value lies within the assigned limits, but only just above the lower limit 18. Therefore, in this case there is the possibility of increasing the rotor rotational speed and raising the productivity. The rotor rotational speed is increased in several steps. The CV value increases until the upper limit 19 is exceeded. The rotor rotational speed is lowered again by the amount of the step performed last. Thus, an optimized working point that has a higher production speed is found, but the CV value still lies within the specified limits.

Figure 3:
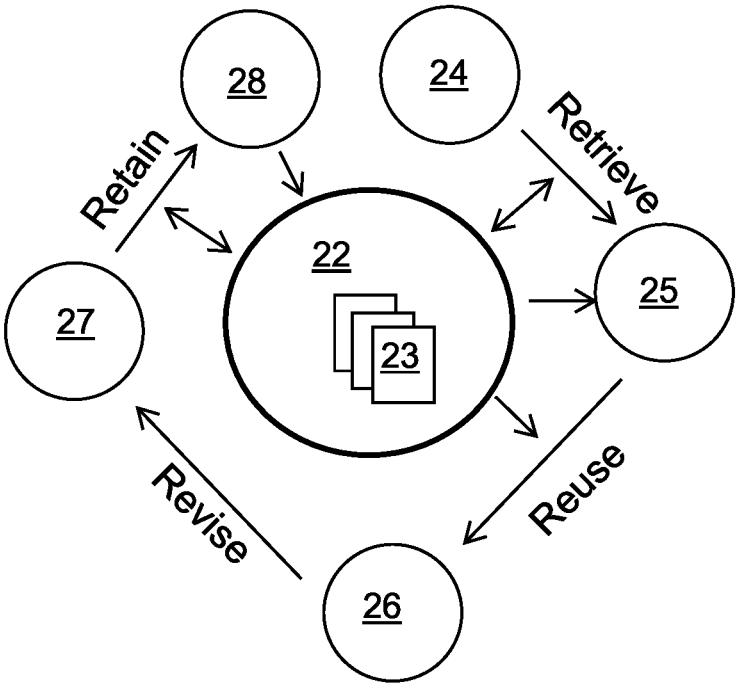
FIG. 3 is a schematic illustration of the optimization in accordance with the principle of case-based reasoning.

FIG. 3 illustrates an optimization of the operation of a spinning machine with regard to quality and productivity using the principle of case-based reasoning. The process occurs largely automatically and is performed by the control device according to the invention, which, for example, comprises a chip having artificial intelligence.

The starting point for the optimization is a case base or a database 22. This database 22 contains a plurality of data sets 23 having optimized operating points of one or more spinning machines under specified conditions. For this purpose, the data sets 23 contain the specified yarn properties, the parameter for setting the production speed, and the resulting target variable. Reference sign 24 defines specified conditions under which the operation of a spinning machine should be optimized. The specified conditions 24 comprise at least the specified yarn properties and a specified limit value for the target variable. The conditions 24 are then compared with the data sets 23, and the data set 22 closest to the conditions 24 is selected ("Retrieve"). The data set 25 results therefrom. By applying this data set 25 under the specified conditions, the applied data set 26 is obtained ("Reuse"). Up to this point, the described method is preferably carried out automatically by the control device. The control device preferably has an interface, which enables editing by the operator ("Revise"). Thus, the data set 27 is obtained, which finally is received into the database 22 as data set 28 ("Retain"). In this way, the control device learns and can draw on a larger database 22 for future optimizations.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A method for optimizing the operation of a spinning machine with regard to quality and productivity, the method comprising:

producing a yarn having a specified yarn property;

sensing during the spinning operation a quality parameter of the yarn, which quality parameter is a measure of a deviation from the specified yarn property, and wherein an upper limit value and a lower limit value for the quality parameter are specified;

specifying a parameter for setting a production speed;

evaluating the quality parameter and the parameter for setting the production speed; and setting the production speed in dependence on a target variable, the target variable comprising the quality parameter.

2. The method according to claim 1, characterised in that a yarn break rate is sensed and evaluated and the target variable comprises the yarn break rate.

3. An apparatus comprising a control device and a spinning machine, for producing a yarn having a specified yarn property, for sensing a quality parameter of the yarn during the spinning operation, which quality parameter is a measure of a deviation from the specified yarn property, and wherein an upper limit value and a lower limit value for the quality parameter are specified, and for specifying a parameter for setting the production speed, the control device being designed to evaluate the quality parameter and the parameter for setting a production speed, and the control device being designed in such a way that the production speed is set by the control device in dependence on a target variable, the target variable comprising the quality parameter.

4. The apparatus according to claim 3, characterised in that the control device is designed to evaluate a yarn break rate, and the target variable comprises the yarn break rate.

5. The apparatus according to claim 3, characterised in that the control device comprises a user interface, on which the parameter for setting the production speed and the target variable are simultaneously displayed.

6. The apparatus according to claim 3, characterised in that the control device is designed to display a time curve of the parameter for setting the production speed and of the target variable.

7. The apparatus according to claim 3, characterised in that a limit value for the target variable can be specified to the control device.

8. The apparatus according to claim 3, characterised in that the control device is designed to determine proposals for a change to the parameter for setting the production speed.

9. The apparatus according to claim 3, characterised in that the control device is designed to create and store data sets, which comprise the specified yarn property, the parameter for setting the production speed, and the associated target variable.

10. The apparatus according to claim 9, characterised in that the control device is designed to compare the data sets with the specified yarn property and with a specified limit value for the target variable and to select a data set for the operation of the spinning machine in accordance with the comparison.

11. The apparatus according to claim 10, characterised in that the control device has an interface for editing the selected data set.

12. The apparatus according to claim 11, characterised in that the control device is designed to apply and store the edited data set.

* * * * *